United States Patent [19]

Mele

[11] 4,195,727

[45] Apr. 1, 1980

[54] DISPLAY CASE FOR JEWELS

[75] Inventor: Joseph E. Mele, Port Washington, N.Y.

[73] Assignee: Mele Manufacturing Co., Utica, N.Y.

[21] Appl. No.: 12,152

[22] Filed: Feb. 14, 1979

[51] Int. Cl.[2] ..... B65D 85/00; A45C 5/12; A47B 77/18

[52] U.S. Cl. ..... 206/45; 190/32; 206/566; 312/293

[58] Field of Search ..... 206/566, 45; 217/7; 190/30, 32; 312/293, 294, 283

[56] References Cited

U.S. PATENT DOCUMENTS

| | | | |
|---|---|---|---|
| 716,551 | 12/1902 | Jaekel | 190/30 |
| 823,778 | 6/1906 | Herbeck | 206/45 |
| 937,545 | 10/1909 | Post | 190/32 |
| 1,090,592 | 3/1914 | Betham | 206/45 |

*Primary Examiner*—William T. Dixson, Jr.
*Attorney, Agent, or Firm*—Kane, Dalsimer, Kane, Sullivan and Kurucz

[57] ABSTRACT

The disclosure is of a display case for jewels which includes display trays. The display trays are nested within the lid of the jewel cases of the invention when the lids are in a closed position. When opened the display trays are rotated outwardly by movement of the lid to a display position on the exterior of the case.

4 Claims, 11 Drawing Figures

DISPLAY CASE FOR JEWELS

BACKGROUND OF THE INVENTION

1. Field of the Invention

The invention relates to jewel cases and more particularly relates to jewel cases adapted to display their contents.

SUMMARY OF THE INVENTION

The invention comprises a display case for jewels, which comprises;

(a) a box enclosure which comprises:

(i) a first pair of opposed sidewalls;

(ii) a second pair of opposed sidewalls positioned between and joining the first pair;

(iii) a closed bottom end; and (iv) an open top end; said sidewalls with the top and bottom ends defining a first chamber for receiving jewels;

(b) a lid enclosure adapted to close the open end of the box enclosure and which comprises:

(i) a third pair of opposed sidewalls;

(ii) a fourth pair of opposed sidewalls positioned between and joining the third pair;

(iii) a closed top end; and (iv) an open bottom end; said third and fourth pairs of sidewalls with the lid enclosure top and bottom ends defining a second chamber;

said lid enclosure being hingedly mounted on the top end of the box enclosure so that when in a first position the bottom end of the lid enclosure is closed by the box enclosure and the top end of the box enclosure is closed by the lid enclosure with the first chamber in open communication with the second chamber and when in a second position the bottom end of the lid enclosure is open for access to the second chamber and the top end of the box enclosure is open for access to the first chamber;

(c) a jewel display tray adapted to nest within the second chamber and which comprises:

(i) a fifth pair of opposed sidewalls;

(ii) a sixth pair of opposed sidewalls positioned between and joining the fifth pair;

(iii) an open top end; and (iv) a closed bottom end;

said tray having a first plane parallel with the closed bottom end of the tray and a second plane perpendicular to the first plane;

(d) means for mounting said tray so that the tray eccentrically rotates on the open top end of the box enclosure, about an axis parallel to the second plane, said tray having a first mounted position above the first chamber wherein the second plane is vertically aligned with the second chamber and a second mounted position wherein the tray shifts outwardly from the top end of the box enclosure along the first plane so that the second plane is only partially vertically aligned with the second chamber;

(e) an elongate lid support member having a first end, a second end and a shank joining the ends thereof, the first member end being pivotally connected to the lid enclosure, the second member end being pivotally connected to the tray and the connections to said lid enclosure and tray being of a character permitting partial rotation of the shank in a direction about the axis of the shank; and (f) means of stopping said tray from eccentrically rotating more than about 90° about the axis parallel to the second plane; whereby (1) when the lid enclosure is in its first position closing the open top end of the box enclosure, the tray is nested within the second chamber of the lid enclosure, positioned in the first mounted position above the first chamber with the second plane aligned with the first chamber;

(2) when the lid enclosure is raised to its second position to open access to the first and second chambers, the elongate lid support member rotates the tray eccentrically along the first plane to the second mounted position until stopped by the means of stopping;

(3) the elongate lid support member serves as a lid support when the tray is stopped; and (4) when the lid enclosure is lowered to its first position closing access to the first and second chambers, the elongate lid support member rotates the tray eccentrically along the first plane to move the tray to its first mounted position.

DETAILED DESCRIPTION OF THE PREFERRED EMBODIMENTS OF THE INVENTION

A complete understanding of the invention may be had from a reading of the following description of the preferred embodiments of the invention read in conjunction with the accompanying drawings of FIGS. 1 through 11, inclusive.

Figure 1:
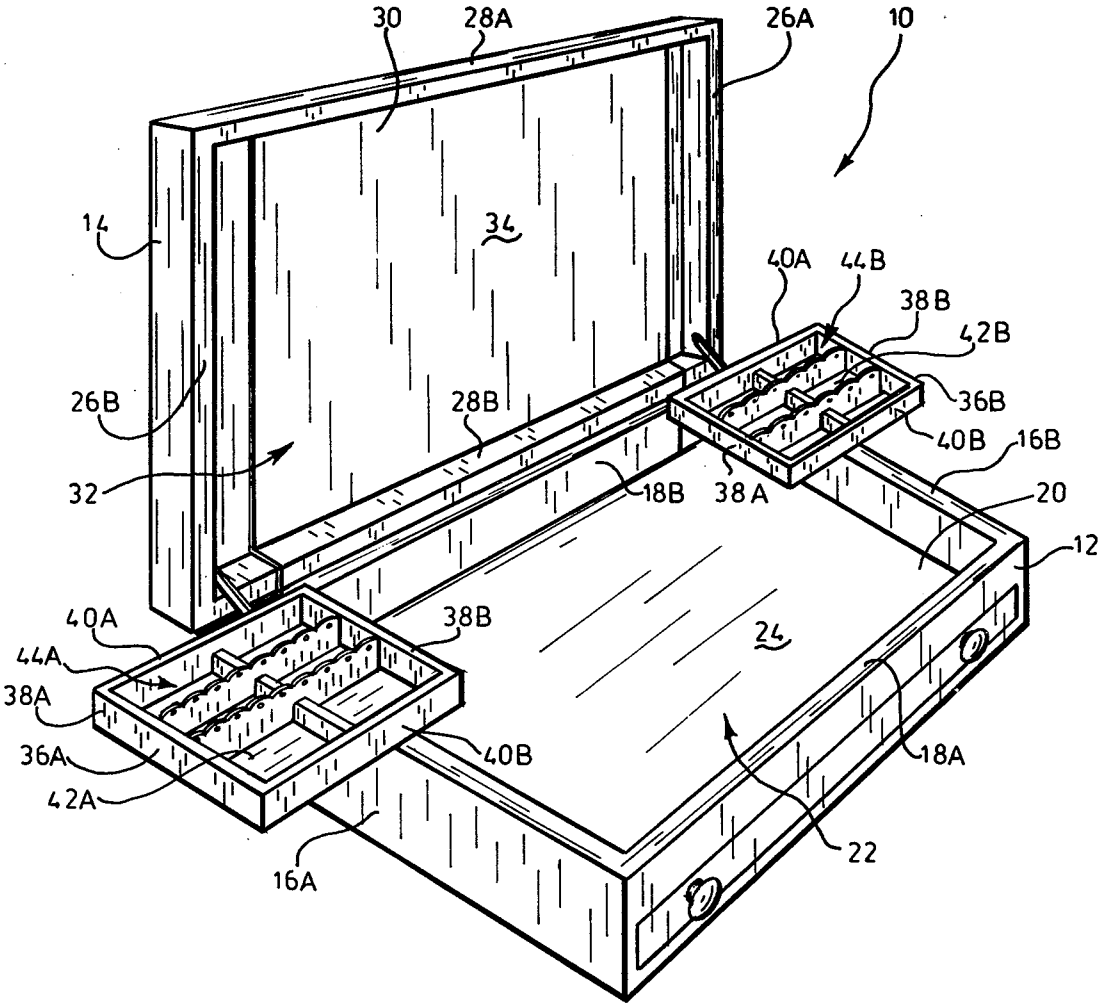
FIG. 1 is a isometric view of an embodiment jewel case of the invention shown in an open or display position.

Referring first to FIG. 1, there is seen an isometric view of an embodiment jewel case 10 of the invention shown in an open or display position. The jewel case 10 comprises a box enclosure component 12 and a lid enclosure component 14. The box enclosure component 12 comprises a first pair of opposed sidewalls 16*a* and 16*b*. A second pair of opposed sidewalls 18*a*, 18*b* are positioned between and join sidewalls 16*a*, 16*b*. The box enclosure 12 has a closed bottom end 20 and an open top end 22. The sidewalls 16*a*, 16*b*, 18*a*, 18*b*, together with ends 20, 22 define an interior chamber 24 for receiving jewels and like articles.

The lid enclosure 14 as shown in FIG. 1 is adapted to close the open end 22 of box enclosure component 12. The lid enclosure 14 comprises a pair of opposed sidewalls 26*a*, 26*b* and an opposed pair of sidewalls 28*a*, 28*b* positioned between and joining sidewalls 26*a*, 26*b*. The lid enclosure component 14 also has closed end 30 and an open bottom end 32. The sidewalls 26*a*, 26*b*, 28*a* 28*b* together with closed end 30 and open end 32 defines an interior chamber 34.

The lid enclosure component 14 is hingedly mounted on top end 22 of box enclosure component 12 (hinges not shown in FIG. 1). As will be seen in FIG. 1, the lid enclosure component 14 is specifically hingedly mounted upon the upper end of sidewall 18*b*. As also shown in FIG. 1, the lid enclosure component 14 is in a first, open position so that access is available to the chambers 24, 34. It will be appreciated that when the lid enclosure 14 is pivoted downwardly in the direction of box enclosure component 12 on its hinges, the lid enclosure component 14 will mate with the box enclosure component 12 so as to close chambers 24, 34 while leaving the chambers 24, 34 in open communication with each other.

Figure 2:
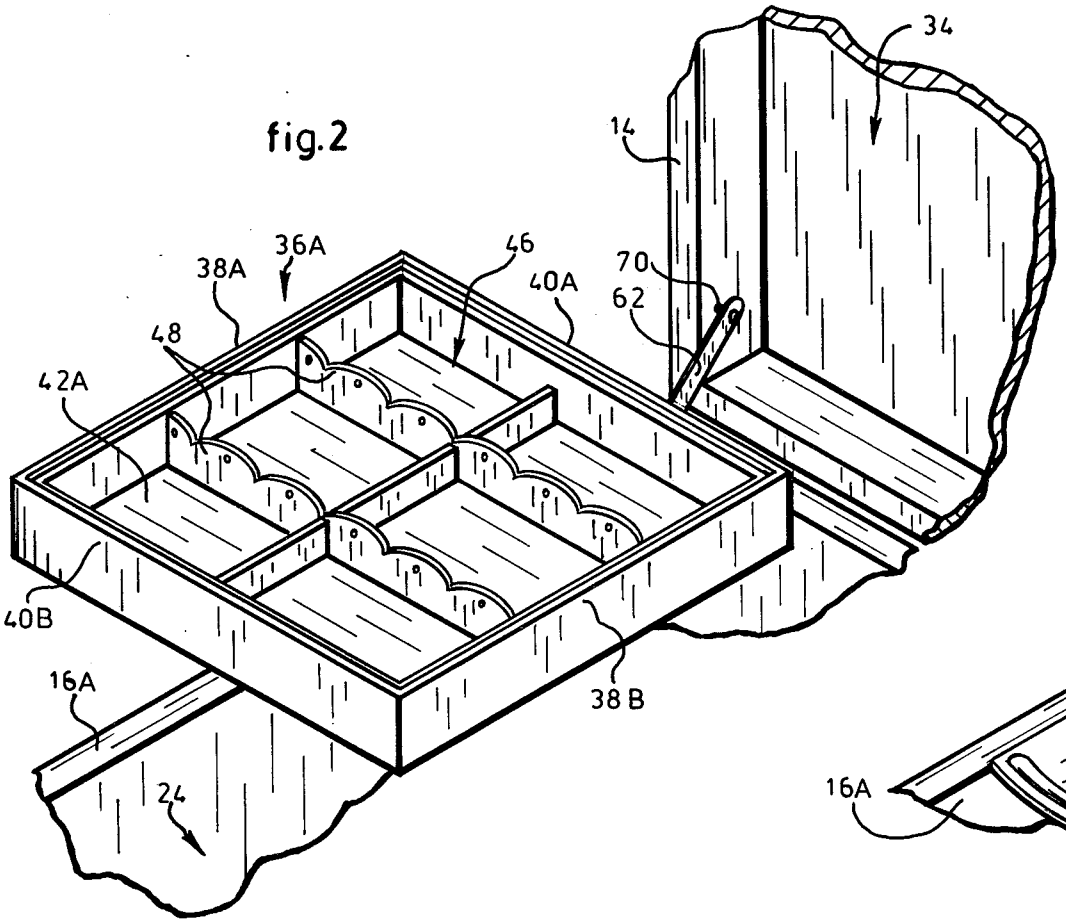
FIG. 2 is an enlarged view of a display tray component of the case shown in FIG. 1.

Mounted on the open end 22 of box enclosure component 12 are display trays 36*a*, 36*b*. More specifically, display tray 36*a* is mounted on the upper surface of sidewall 16*a* and display tray 36*b* is likewise mounted on the upper end of sidewall 16*b*. Each of the display trays 36*a*, 36*b* are adapted to nest within chamber 34 when the lid enclosure component 14 is in the closed position, that is closing chambers 24, 34. Each of the trays 36*a*, 36*b* also comprise a pair of opposed sidewalls 38*a* and 38*b*. Positioned between and joining sidewalls 38*a*, 38*b* are sidewalls 40*a* and 40*b*. Each of the display trays 36*a*, 36*b* have a closed bottom end 42*a*, 42*b* and an open end 44*a*, 44*b*. The trays 36*a*, 36*b* have a first plane parallel with the closed bottom end 42*a*, 42*b* and a second plane perpendicular to the first plane. Referring now to FIG. 2, one may see an enlarged view of the display tray 36*a* as it is mounted on the upper end of sidewall 16*a*. The inner chamber 46 of display tray 36*a* contains a support liner 48 for containing jewels and like items. It will be observed that the display tray 36*a* is mounted in such a position with the lid enclosure component 14 raised that the second plane of tray 36*a*, that is the plane vertical to the plane parallel to the bottom 42*a* is misaligned with interior chamber 24. When the lid enclosure component 14 is closed to deny access to chamber 24, display tray 36 will have been moved inwardly to nest within the chamber 34. The means of moving display 36*a* from its display position to the interior of chamber 34 for nesting will be described in more detail hereinafter.

Figure 3:
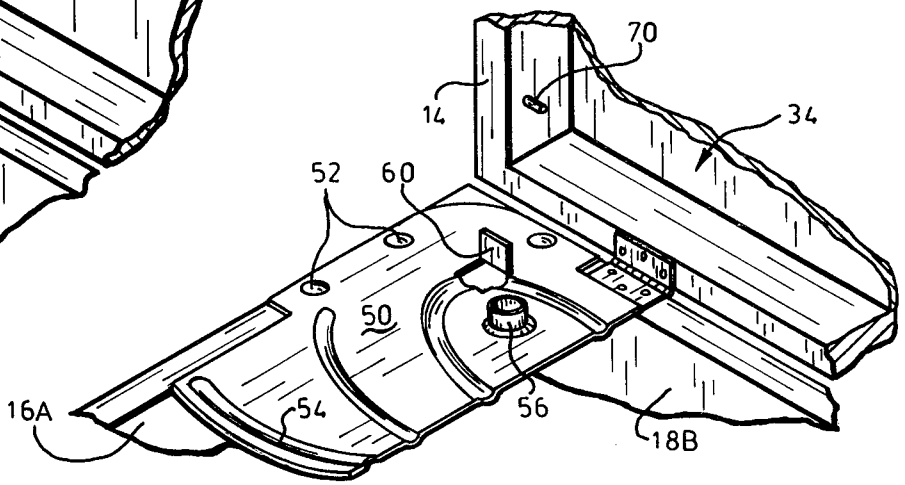
FIG. 3 is a view of the means for mounting the tray seen in FIG. 2, on the case of FIG. 1.
Figure 4:
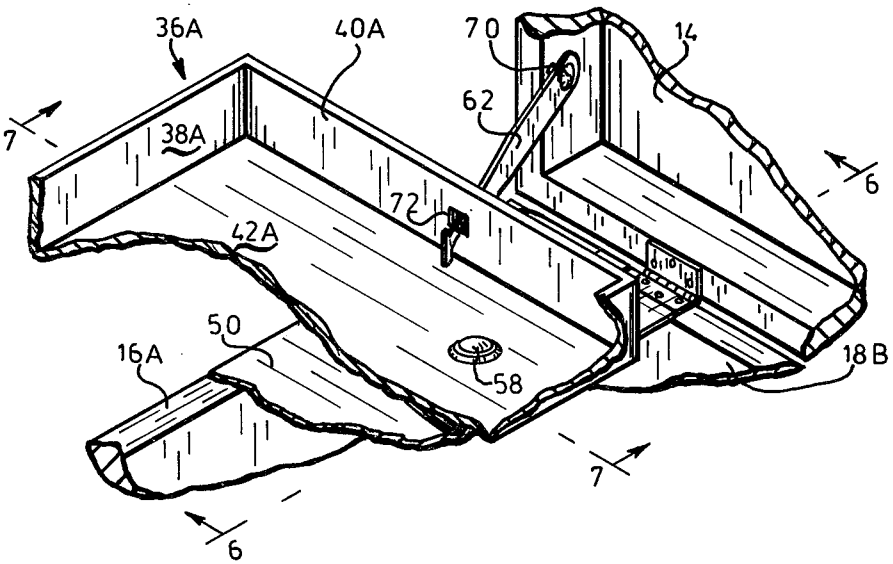
FIG. 4 is a view as seen in FIG. 2, partially cutaway to show the means of mounting the tray component.

As a means for mounting the display trays 36*a*, 36*b* on the open end 22 of box enclosure component 12 I prefer such means to permit eccentrical rotation of the display trays 36*a*, 36*b*. Such a means is shown in FIG. 3. In FIG. 3, the display tray 36*a* has been removed to show an underlying support plate 50 which is affixed to the upper ends of sidewalls 16*a*, 18*b*. Affixation may be by any conventional means such as nails 52. In the preferred embodiment of the invention support plate 50 includes raised portions 54 to reduce the friction between bottom 42*a* and support plate 50. Hub 56 is designed to mate with an axle eccentrically located in bottom 42*a* of display tray 36*a*. Referring now to FIG. 4, a view as seen in FIG. 2 partially cut away to shown the means of mounting the tray 36*a*, further details of the means for mounting may be observed. As shown in FIG. 4, display tray 36*a* is eccentrically mounted to hub 56 through axle 58 (which is secured to bottom end 42*a* of display tray 36*a*) in such a manner that the display tray 36*a* will pivotally and eccentrically rotate on the support plate 50 so that the second, vertical plane described above will align with and move out of alignment with the interior chambers 24, 34. Positioning of the hub 56 and axle 58 in relation to bottom 42*a* may be determined by trial and error methods to obtain the desired movement, i.e.; movement of tray 36*a* to the display position shown in FIGS. 1 and 2 and eccentric rotation of the display tray 36*a* to an aligned position so that upon closure of lid component 14 the display trays 36*a*, 36*b* will nest within the closed chamber 34. Desirably, eccentric rotation of the display tray 36*a* will not exceed about 90° outward from the position of the tray 36*a* when nested within chamber 34. To assure the limited rotation, a raised flange 60 (see FIG. 3) mates with the exterior of sidewalls 40*a* when the tray 36*a* is in its display position, i.e.; out of alignment of its vertical plane with chambers 24, 34.

As also shown in FIG. 4, an elongate lid support member 62 supports lid enclosure component 14 in its open position. The elongate lid support member 62 is shown in greater detail in the isometric drawing of FIG. 5. The member 62 has a first end 64 and second end 66 joined by shank 68. Referring now to FIG. 4, it will be seen that the member 62 is pivotally connected at end 64 through pin connection 70 to the lid 14. This permits pivoting of member 62 about the axis of pin 70 when lid enclosure component 14 is raised or lowered. The end 66 of member 62 is also pivotally connected to tray 36*a* by means of a slot 72 in sidewall 40*a*. Loose engagement of a narrowed portion 74 of shank 68 permits axial movement of member 62 within slot 72. However, the enlarged portion of shank 68 causes positive engagement of member 62 with sidewall 40*a* as does the expanded portion 76 at end 66 of elongate member 62. Thus, when lid enclosure component 14 is lowered, the wider portion of shank 68 engages with sidewall 40*a* of display tray 36 and provides motivation for the eccentric rotation of tray 36*a* inwardly to the position wherein it is aligned vertically with the chambers 24, 34. When the lid enclosure component 14 is raised, the portion 76 of shank 68 engages the inner surface of wall 40*a* to pull tray 36*a* out of alignment with the chambers 24, 34 and moves the tray 36*a* into its display position as shown in FIGS. 1 and 2, upon stopping by stop 60.

Figure 6:
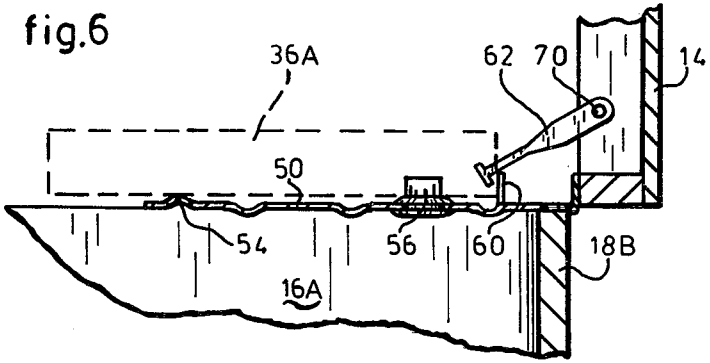
FIG. 6 is a view along lines 6—6 of FIG. 5.
Figure 5:
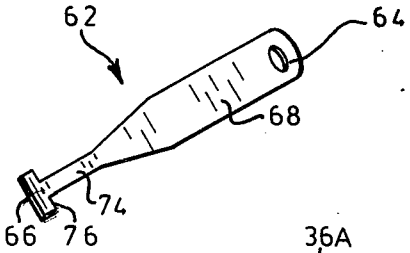
FIG. 5 is an isometric view of a lid support member employed as a component of the case seen in FIG. 1.

Further details of the mounting of tray 36*a* on the open end 22 of box enclosure component 12 may be seen by now referring to FIG. 6, a view along lines 6—6 of FIG. 5.

Figure 7:
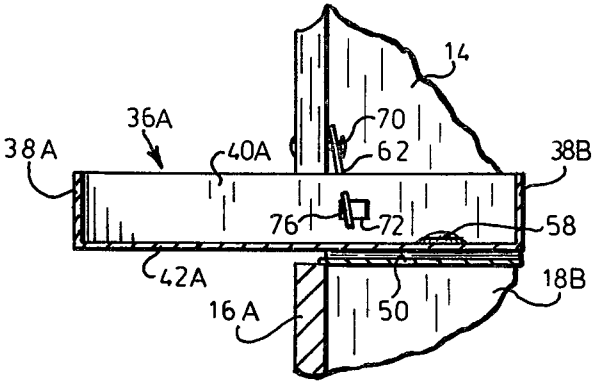
FIG. 7 is a view along lines 7—7 of FIG. 5.

FIG. 7 is a view along lines 7—7 of FIG. 5 and show the loose connection of member 62 between lid enclosure component 14 and tray 36*a*. The elongate member 62 makes loose connection to permit limited rotation of the member 62 in a direction about the axis of shank 68. The limited rotation of member 62 about its shank 68 axis is shown by the arrow in FIG. 7. This loose or limited rotation of member 62 is important to the structure of the invention to prevent binding of movement when the lid enclosure component 14 is raised or lowered. If a rigid connection is made, the moving parts will bind. Preferably rotation is limited to from about 2 to 45 degrees.

Figure 9:
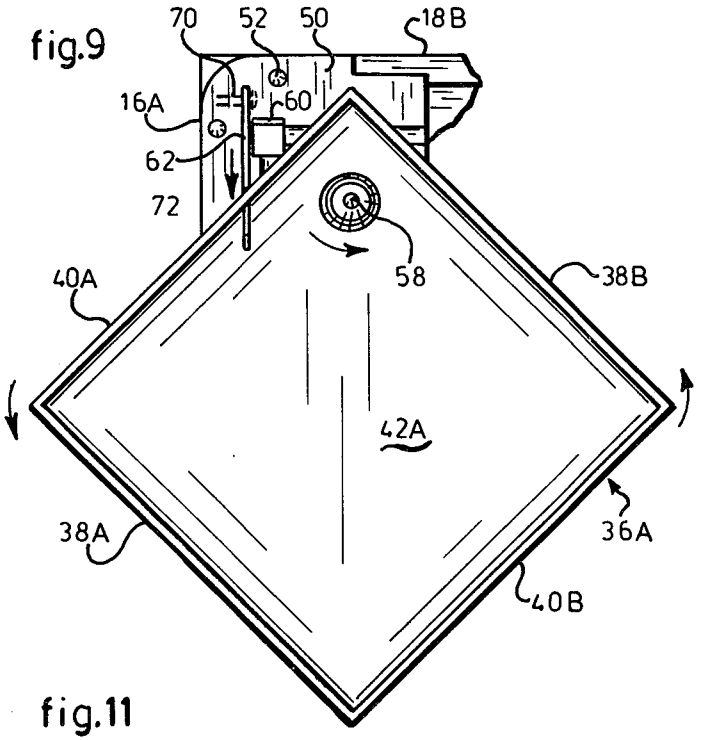
FIG. 9 is a view as seen in FIG. 8 but with the lid of the embodiment case shown in FIG. 1 partially closed and the tray component partially rotated inward to a nesting position within the lid.
Figure 11:
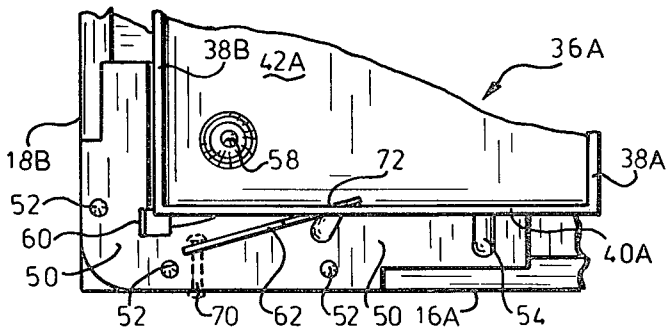
FIG. 11 is a view as in FIG. 8 but with the lid closed and the tray component in a position nesting inside the lid.
Figure 8:
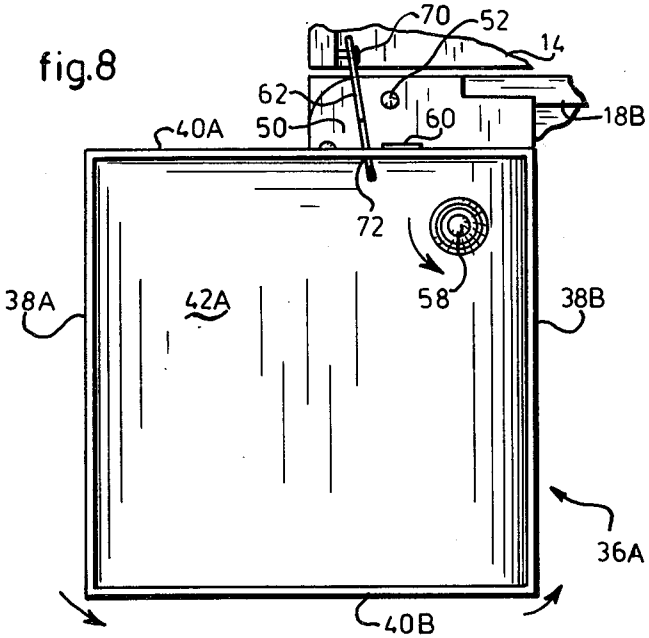
FIG. 8 is a view from above of the tray component shown in FIG. 2.
Figure 10:
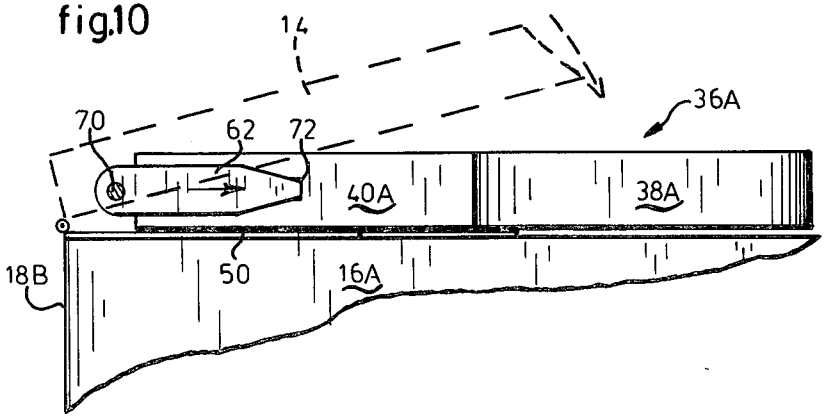
FIG. 10 is a side view of the tray as shown in FIG. 9.

The operation of the mechanisms comprising jewel case 10 will now be described in relation to the drawings of FIGS. 8 through 11, inclusive. FIG. 8 is a view from above of the tray component 36a as shown in FIG. 2. It will be appreciated that in this position, the lid enclosure component 14 is in its full open position. Note the loose connection of member 62 on pin 70. As the lid enclosure component 14 is lowered to close access to chambers 24, 34 tray 36a will eccentrically rotate in the direction shown by the arrows, about the axis of axle 58. Referring to FIG. 9, one may see a view as seen in FIG. 8 but with the lid 14 of the embodiment jewel case shown in FIG. 1, partially closed and the tray 36a partially rotated inward to a nesting position to be shown hereinafter. Movement of the tray 36a is actuated and provided by movement of lid support member 62 in the direction shown by the arrow. FIG. 10 is a side view of the tray as shown in FIG. 9 and shows further details of the position of tray 36a during closure of lid 14. When lid 14 has completely closed access to chambers 24, 34 the elongate lid support member 62 will have completed rotation of the display tray 36a so that it is fully aligned in a vertical plane with chambers 24, 34 as shown in FIG. 11. In this position, the tray 36a will be fully nested within chamber 24 of lid enclosure component 14. Note again in FIG. 11 the loose connection of lid support member 62 on pin 70 which permits its flexible rotation around the axis of the shank 68 so that there is no binding of the moving parts. When the lid enclosure component 14 is raised, the movement of display tray 36a is reversed, the tray 36a being pulled or tracted out of its nesting position to its display position by engagement of the portion 76 of shank 68 with the inner surface of sidewall 40a.

Although the above description has been limited in places to the operation of tray 36a, it will be appreciated that this description also applies to tray 36b previously described. In fact, in the preferred embodiment 10, trays 36a and 36b are for all intents and purposes identical in construction and operation.

Those skilled in the art will also appreciate that many modifications may be made to the above description preferred embodiment of the invention as shown in FIGS. 1 through 11, inclusive, without departing from the spirit and scope of the invention. For example, the display jewel cases of the invention may be constructed of any convenient and conventional material including for example, polymeric resins, wood, metal, fabrics and like materials.

What is claimed is:

1. A display case for jewels, which comprises:

(a) a box enclosure which comprises:
  (i) a first pair of opposed sidewalls;
  (ii) a second pair of opposed sidewalls positioned between and joining the first pair;
  (iii) a closed bottom end; and
  (iv) an open top end;

said sidewalls with the top and bottom ends defining a first chamber for receiving jewels;

(b) a lid enclosure adapted to close the open end of the box enclosure and which comprises:
  (i) a third pair of opposed sidewalls;
  (ii) a fourth pair of opposed sidewalls positioned between and joining the third pair;
  (iii) a closed top end; and
  (iv) an open bottom end;

said third and fourth pairs of sidewalls with the lid enclosure top and bottom ends defining a second chamber;

said lid enclosure being hingedly mounted on the top end of the box enclosure so that when in a first position the bottom end of the lid enclosure is closed by the box enclosure and the top end of the box enclosure is closed by the lid enclosure with the first chamber in open communication with the second chamber and when in a second position the bottom end of the lid enclosure is open for access to the second chamber and the top end of the box enclosure is open for access to the first chamber;

(c) a jewel display tray adapted to nest within the second chamber and which comprises:
  (i) a fifth pair of opposed sidewalls;
  (ii) a sixth pair of opposed sidewalls positioned between and joining the fifth pair;
  (iii) an open top end; and
  (iv) a closed bottom end;

said tray having a first plane parallel with the closed bottom end of the tray and a second plane perpendicular to the first plane;

(d) means for mounting said tray so that the tray eccentrically rotates above one of said first pair of opposed sidewalls, on the open top end of the box enclosure, about an axis parallel to the second plane, said tray having a first mounted position above the first chamber wherein the second plane is vertically aligned with the second chamber and a second mounted position wherein the tray shifts outwardly from the top end of the box enclosure along the first plane so that the second plane is only partially vertically aligned with the second chamber;

(e) an elongate lid support member having a first end, a second end and a shank joining the ends thereof, the first member end being pivotally connected to the inner surface of one of the third pair of opposed sidewalls of the lid enclosure, the second member end being pivotally connected to one of the sixth pair of opposed sidewalls of the tray and the connections to said lid enclosure and tray being of a character permitting partial rotation of the shank in a direction about the axis of the shank; and (f) means of stopping said tray from eccentrically rotating more than about 90° about the axis parallel to the second plane; whereby
  (1) when the lid enclosure is in its first position closing the open top end of the box enclosure, the tray is nested within the second chamber of the lid enclosure, positioned in the first mounted position above the first chamber with the second plane aligned with the first chamber;
  (2) when the lid enclosure is raised to its second position to open access to the first and second chambers, the elongate lid support member rotates the tray eccentrically along the first plane to the second mounted position until stopped by the means of stopping;
  (3) the elongate lid support member serves as a lid support when the tray is stopped; and
  (4) when the lid enclosure is lowered to its first position closing access to the first and second chambers, the elongate lid support member rotates the tray eccentrically along the first plane to move the tray to its first mounted position.

2. The case of claim 1 wherein a second jewel display tray (e) is also mounted as described in (d) above, but above the opposing sidewall of said first pair of opposing sidewalls and a second elongate lid support member (e) connects the second tray to the lid enclosure component as described in (e) above, but the first member end of the second elongate lid support member is connected to the inner surface of the opposing sidewall of said third pair of opposing sidewalls.

3. The case of claim 1 wherein the means for mounting comprises a support plate attached to the sidewalls of the box enclosure (a), a hub on the plate and a mated axle located eccentrically in the bottom of the tray.

4. The case of claim 3 wherein the stop means is a flange positioned on the support plate.

* * * * *